US012329273B2

(12) United States Patent
Kim

(10) Patent No.: US 12,329,273 B2
(45) Date of Patent: Jun. 17, 2025

(54) FOLDING TABLE

(71) Applicant: ING LEISURE CO., LTD., Pyeongtaek-si (KR)

(72) Inventor: Cheon Ki Kim, Pyeongtaek-si (KR)

(73) Assignee: ING LEISURE CO., LTD., Pyeongtaek-si (KR)

( * ) Notice: Subject to any disclaimer, the term of this patent is extended or adjusted under 35 U.S.C. 154(b) by 198 days.

(21) Appl. No.: 18/209,450

(22) Filed: Jun. 13, 2023

(65) Prior Publication Data

US 2023/0397718 A1 Dec. 14, 2023

(30) Foreign Application Priority Data

Jun. 14, 2022 (KR) ..... 10-2022-0071915

(51) Int. Cl.

| | |
|---|---|
| ***A47B 3/06*** | (2006.01) |
| ***A47B 3/12*** | (2006.01) |
| *A47B 9/00* | (2006.01) |

(52) U.S. Cl.

CPC ..... *A47B 3/06* (2013.01); *A47B 3/12* (2013.01); *A47B 2009/003* (2013.01)

(58) Field of Classification Search

CPC .. A47B 3/06; A47B 3/12; A47B 3/002; A47B 2009/003; A47B 1/02

USPC ..... 108/153.1, 115

See application file for complete search history.

(56) References Cited

FOREIGN PATENT DOCUMENTS

| | | | | | |
|---|---|---|---|---|---|
| JP | 2013052160 | A | * | 3/2013 | ..... A47B 3/083 |
| KR | 100939518 | B1 | * | 2/2010 | |
| KR | 101332707 | B1 | * | 11/2013 | |
| KR | 101375281 | B1 | * | 3/2014 | |
| KR | 20160045366 | A | * | 4/2016 | |
| KR | 20240146381 | A | * | 10/2024 | |
| KR | 102759273 | B1 | * | 1/2025 | |
| WO | WO-2016060383 | A1 | * | 4/2016 | ..... A47B 1/03 |

OTHER PUBLICATIONS

2013052160 English translation (Year: 2013).*

* cited by examiner

*Primary Examiner* — Janet M Wilkens
(74) *Attorney, Agent, or Firm* — Franklin & Associates International Inc; Matthew F. Lambrinos

(57) ABSTRACT

The present technology relates to a folding table, and when the table is unfolded or folded, the table tops are connected by a hinge, and the legs placed inside the four corners are also linked to the operation, so that the table tops and legs are unfolded or folded at once. When the table is unfolded, the legs support all of the top plates by supporting the above corner plates, and include a pair of leg plates that are connected to each other when folded or unfolded through a hinge, and form a sliding rail to adjust the length of the leg.

6 Claims, 7 Drawing Sheets

FOLDING TABLE

CROSS-REFERENCE TO RELATED APPLICATION

This application claims priority to and the benefit of Korean Patent Application No. 10-2022-0071915, filed on Jun. 14 2022, at the Korean Intellectual Property Office, the disclosure of which is incorporated herein by reference in its entirety.

BACKGROUND OF THE INVENTION

Field of the Invention

The present invention relates to a folding table, and specifically, a FOLDING TABLE which is useable by unfolding the same, in addition, can minimize a volume thereof by selectively folding plates constituting the table to thus enable storage and transport thereof, is easy to extend a length of table legs, can be firmly supported in an unfolded state of the table, and is easy to selectively extend or enlarge the plates to thus improve use efficiency.

Description of the Related Art

With increasing interest to leisure life in recent years, the outdoor camping industry has been greatly developed.

Among them, the demand for tables essential for cooking, etc. during outdoor camping is increasing significantly, and the technology development of prefabricated tables with portability and convenient installation structure is being activated.

In general, prefabricated tables for outdoor use adopt a method in which an upper plate and legs are separated and/or assembled together, and have a structure in that a user carries these components separately and then installs the same at an outdoor camping site. Conventionally, the upper plate is separated or cylindrical legs having different diameter are designed in a foldable form in order to improve portability.

However, there was a problem in that plural components or parts are separated respectively according to assembly and disassembly, causing loss of the parts as well as base materials. Further, abrasion phenomenon caused due to friction between separate parts was also induced.

As a prior art for solving these problems, Patent Document 1 discloses an outdoor table having a structure in which four upper plates and legs are integrally connected to pivotally rotate and the legs are folded in conjunction with a folding operation of the upper plates.

The above-mentioned prior patent document 1 has a structure in which: the upper plates and the leg parts are integrated so that there is no need to disassemble the upper plate and the leg; portability is improved because it has a form of being easily folded by hands; the outdoor table can be used for general household use; in addition, it can lead a suitable use for outdoor camping.

However, with regard to the conventional folding table such as Patent Document 1, the leg part is configured in a wide-top and narrow-bottom shape similar to a triangle or a triangular pyramid, in which the leg part is narrower toward the lower side, so that it is impossible to extend a length of the leg part, hence causing inconvenience in use.

Further, when a load is applied to a hinge connection site of the plates having a folding and unfolding structure among the top plates in a process of unfolding and using the table, the plates are undesirably folded and cause deformation in an installed shape of the table, hence making it impossible to use. Moreover, there was a problem of causing damage of the base material or safety accidents.

In addition, since the top plates constituting the table have a limited area and, although it needs to place various foods, cooking tools and/or cooking utensils on the top plate during eating, only a limited quantity thereof could be placed on the top plate, hence causing inconvenience when eating.

PRIOR ART LITERATURE

Patent Literature (Patent Document 0001) Korean Registered Patent Publication No. 10-1375281 (Mar. 17, 2014; Published)

SUMMARY OF THE INVENTION

Technical Problem to be Solved

The present invention has been devised to solve the above problems, and it is an object of the present invention to provide a FOLDING TABLE that is useable by unfolding the table, can minimize a volume thereof by selectively folding plates constituting the table to thus enable storage and transport thereof, is easy to extend a length of each table leg, can be firmly supported in an unfolded state of the table, and is easy to selectively extend or enlarge the plates to thus improve use efficiency.

Technical Solution

In order to achieve the above object, the FOLDING TABLE according to the present invention may include: a front plate and a rear plate disposed on a rim of a space to form the space in the center when the table is unfolded; a left plate and a right plate, which are composed as a pair of plates to be coupled through a hinge such that these plates can be folded and unfolded about a center portion in front and rear directions as a boundary; a corner plate which is disposed at the edge of the table in order to connect the front plate with the left and right plates, and the rear plate with the left and right plates, respectively, when unfolding the table, and consists of a pair of plates coupled through a hinge to enable folding and unfolding about the center portion as a boundary; and a pair of leg plates which is coupled to a pair of plate bottom surfaces to form the corner plate, respectively, in a shape of wide-top and narrow-bottom to become narrower toward a lower side in order to support the corner plate, which in turn supports the front, rear, left and right plates, wherein the pair of leg plates is interconnected through a hinge to overlap while being in surface contact when the corner plate is folded, and wherein the pair of leg plates may include: a pair of main leg parts that is coupled to the pair of plate bottom surfaces constituting the corner plate, respectively, includes sliding rails formed on an outer surface in a longitudinal direction and a plurality of guide projections protruding inwardly, which is formed on both sides in the longitudinal direction; and a pair of auxiliary leg parts that is fitted and coupled to the sliding rails in the longitudinal direction to thus ascend and descend while sliding, includes sliding grooves and guide steps formed on both sides so that the guide projections are fitted to the sliding grooves to thus guide the sliding, wherein the auxiliary leg parts are interconnected through a soft hinge at a lower end thereof to be coupled to the main leg parts, respectively, to thus extend a length of the pair of leg plates.

The left plate and the right plate may further include each support block coupled to the bottom surface of the center portion in front and rear directions to interlock with the hinges of the left plate and right plate to thus support the left plate and right plate in an unfolded state, wherein the support block may include: a locking groove formed on the inside to allow a support means to be inserted and slide therein; a stopper projection protruding from the locking groove in order to restrict insertion and sliding of the support means; and a locking projection fitted to a locking rail formed in an "L" shape on the support means when the support means is inserted into the locking groove, so as to guide insertion of the support means into the left or right side as well as sliding toward the center portion.

The pair of auxiliary leg parts may include a plurality of fitting holes formed along the longitudinal direction, while the pair of main leg parts may be provided with a leaf spring at the lower end of the sliding rail and a fitting projection protruding outward from the leaf spring, so that the fitting projection can be selectively fitted to the fitting holes according to ascending an descending by sliding the auxiliary leg parts.

The left plate and the right plate may be each provided with a plurality of mounting blocks coupled to one another at an inner end facing the above space while protruding toward the space, wherein the left and right ends of a plurality of seating plates separably connected to one another are seated on the mounting blocks to thus cover the space.

The plurality of seating plates may be separably coupled to one another by forming coupling projections or coupling grooves corresponding to one another on front and rear ends thereof in the left and right directions, wherein the seating plates may be separably connected and coupled to the front, rear, left and right plates by forming extension projections or extension grooves corresponding to the coupling projections or coupling grooves at opposite outer ends of the space.

When the table is folded, the left and right plates folded at the hinge as a boundary while the corner plates are folded to overlap may be interposed between the bottom surfaces of the front and rear plates. Further, the pair of leg plates at each of the corner plates, which connect the front plate with the left and right plates, may be in surface contact with each other to overlap and then may be interposed between the bottom surfaces of the left and right plates and the bottom surface of the front plate in front of a site where the left plate and the right plate are folded and top surfaces thereof are in surface contact with each other. Similarly, the pair of leg plates at each of the corner plates, which connect the rear plate with the left and right plates, may be in surface contact with each other to overlap and then may be interposed between the bottom surfaces of the left and right plates and the bottom surface of the rear plate at the rear of the site where the left plate and the right plate are folded and top surfaces thereof are in surface contact with each other.

Effect of Invention

As described above, with regard to the FOLDING TABLE according to the present invention, the pair of auxiliary leg parts constituting a pair of leg plates are integrally connected through a soft hinge so that these auxiliary leg parts can easily respond to the leg plates in a wide-top and narrow-bottom shape similar to a triangle or triangular pyramid to become narrower toward the lower side thereof, and slide downward from the main legs parts to thus extend a length of the leg plate while firmly supporting the corner plates, thereby stably supporting the front, rear, left and right plates.

Further, when the table is unfolded, the support means is maintained in a state of slidably moving to the center portion while being inserted into the left or right side (space side) of the support block, so as to firmly support the left and right plates which in turn prevents undesirable folding due to action of external force, thereby effectively ensuring stable use.

Further, when the table is folded, the table is moved to the left or right side (space side) of the support block while the locking projection is fitted to the locking rail of the support means and thus the table is folded without being completely separated from the support block, so that it can not only eliminate the fear of loss of the support means but also do not interfere with the pair of leg plates that come into contact with each other to overlap, thereby attaining effects of stably maintaining the table in a folded state. Moreover, an area of the plates constituting the table may be enlarged and secured by means of the seating plates covering the space, in addition, according to the configuration of extension grooves or extension projections possibly coupled to the coupling projections or coupling grooves, it is possible to induce selective coupling of the seating plates with the front, rear, left and right plates and thus to easily extend or enlarge the plates, thereby increasing use efficiency.

BRIEF DESCRIPTION OF THE DRAWINGS

The above and other objects, features and other advantages of the present invention will be more clearly undrstood from the following detailed description taken in conjunction with the accompanying drawings, in which.

DETAILED DESCRIPTION OF THE INVENTION

Figure 1:
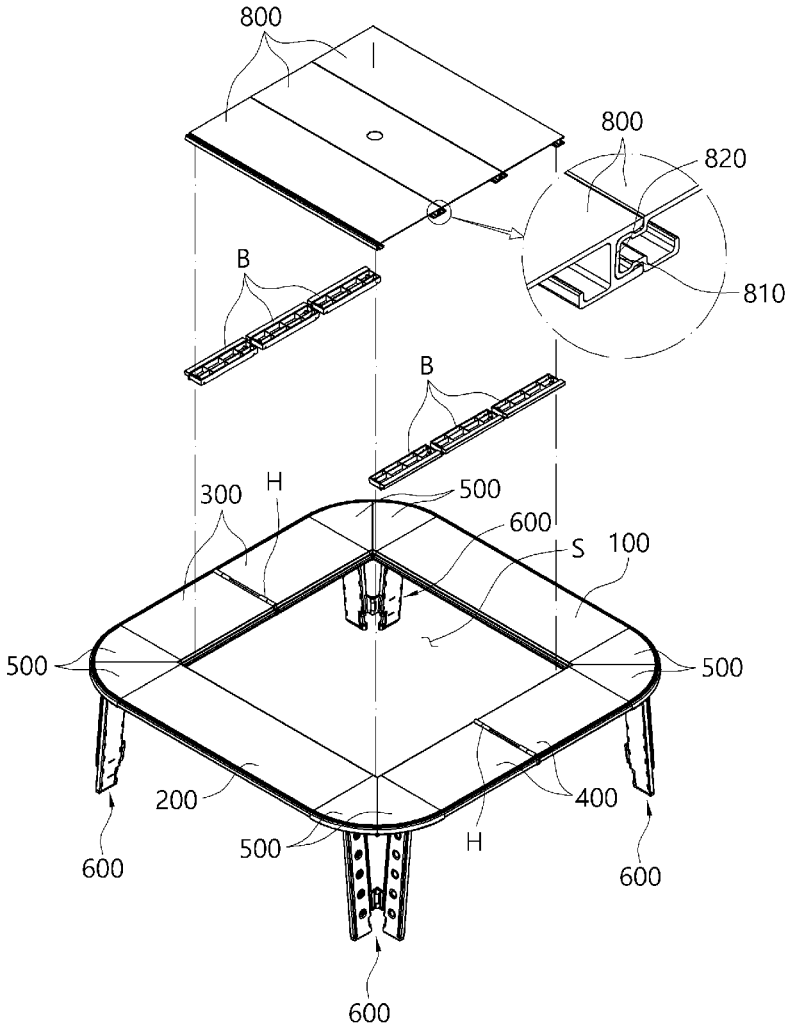
FIGS. 1 and 2 are an exploded perspective view and a perspective view schematically illustrating a FOLDING TABLE according to the present invention.
Figure 2:
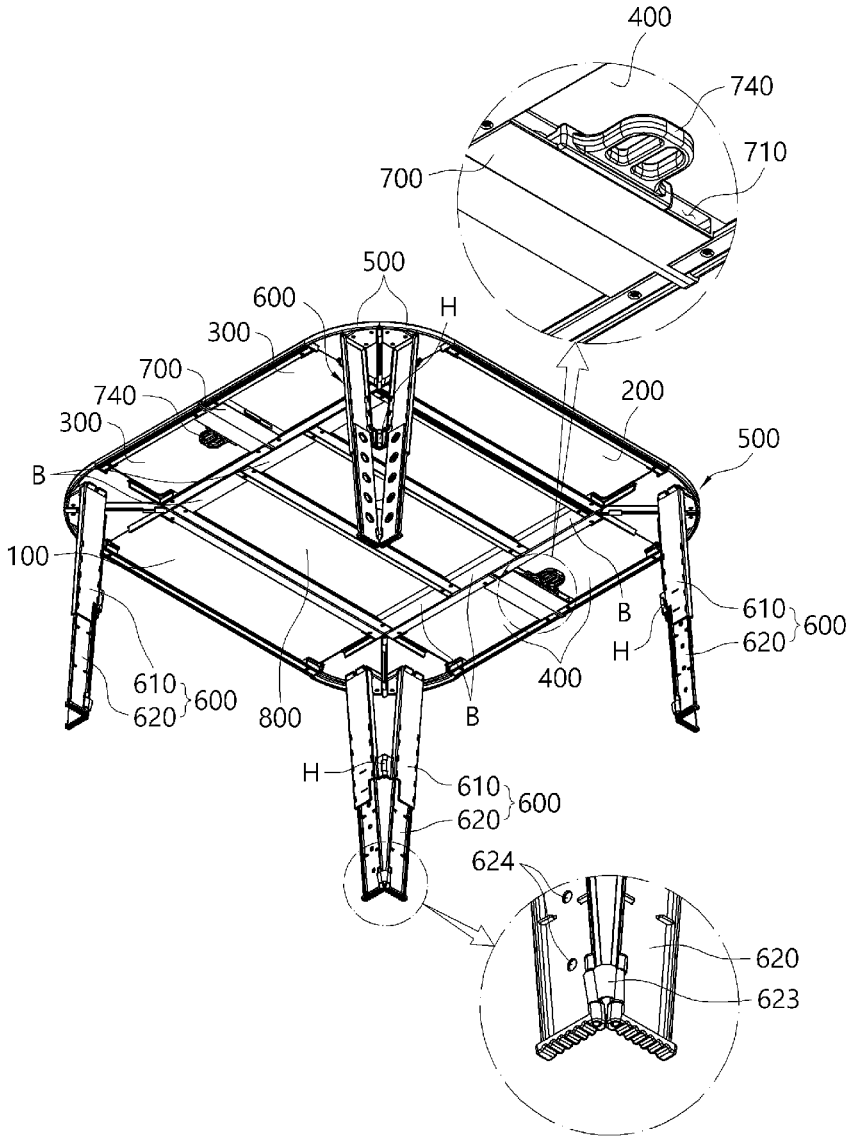
Figure 3:
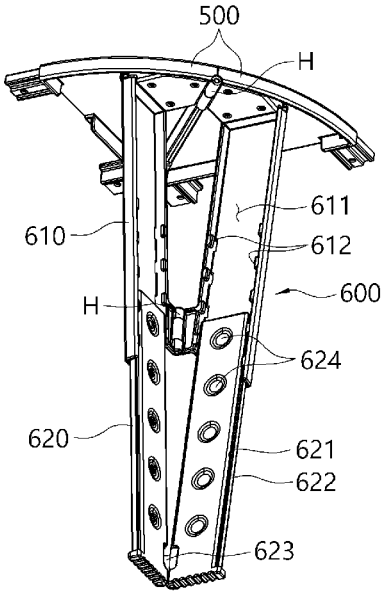
FIGS. 3 and 4 are a perspective view and an exploded perspective view schematically illustrating the leg plate of the FOLDING TABLE according to the present invention.
Figure 4:
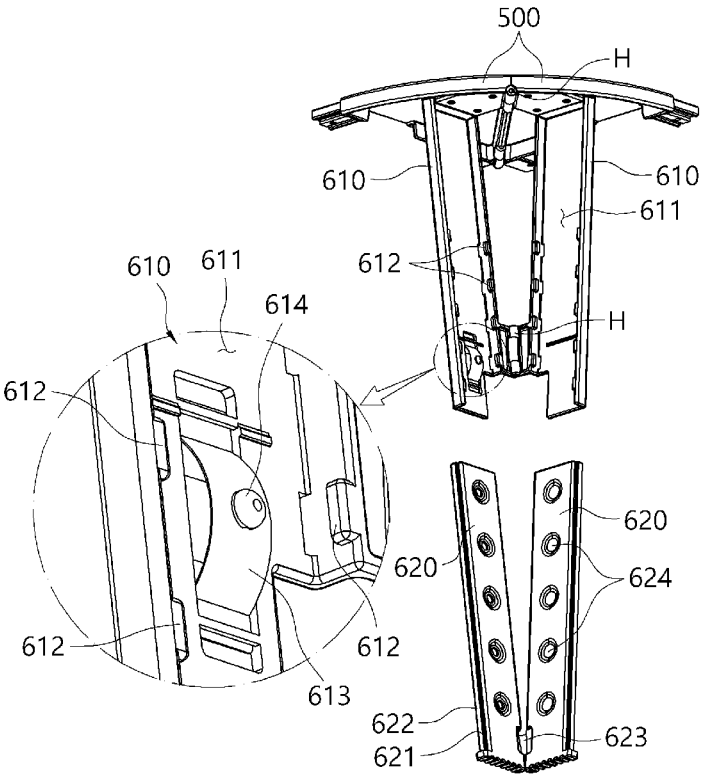
Figure 5:
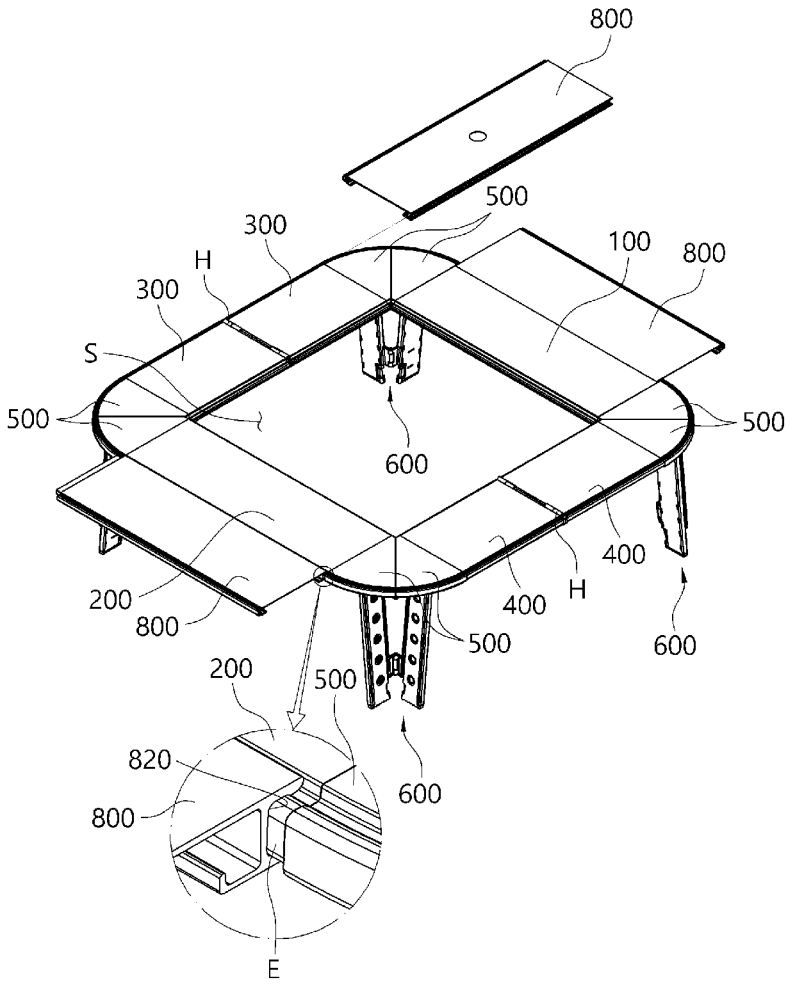
FIGS. 5 to 7 are an exploded perspective view and a perspective view schematically illustrating a folding table according to the present invention.
Figure 6:
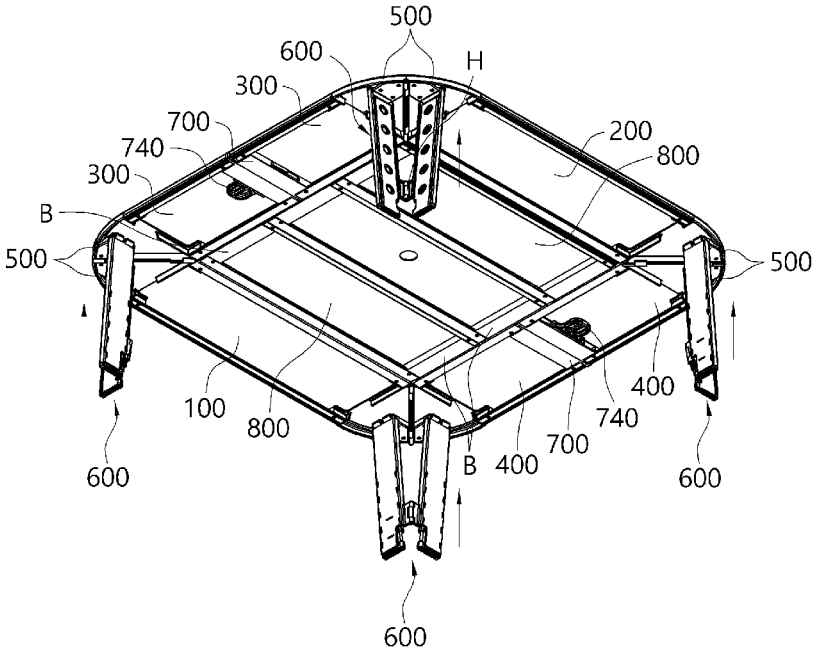

Hereinafter, the configuration and operation of specific embodiments of the present invention will be described in detail with reference to the accompanying drawings.

Herein, when adding reference numerals to the components of each drawing, it should be noted that only the same components are marked with the same reference numerals as much as possible even though they are displayed on different drawings.

Further, in the description of the present invention, a detailed description of related known functions or configurations will be omitted so as not to obscure the gist of the present invention.

Further, when a part "includes" a certain component, this means that other components may be further included rather than being excluded, unless otherwise stated.

Further, in the description of the present invention, upper and lower or longitudinal directions are based on the installation state such that the corner plate is on the upper side of the leg plate when the table is unfolded, while the left and right or width directions will be described based on a direction in which the left and right plates are installed.

In addition, the front and rear directions are based on the installation state where the front plate and the rear plate are arranged in the front and rear directions of the space, the expression of "inside" refers to an inner direction of individual components, an inner direction that is divided by the components, or a site or part existing in the inner direction, while the expression of "outside" will be explained as referring to the direction opposite to the above expression of the inside or a site or part existing in the above opposite direction.

The present invention relates to a FOLDING TABLE that is useable by unfolding the table, in addition, can minimize a volume thereof by selectively folding plates constituting the table to thus enable storage and transport thereof, is easy to extend a length of table legs, can be firmly supported in an unfolded state of the table, and is easy to selectively extend or enlarge the plates to thus improve use efficiency.

The configuration of the present invention for the above effects may basically include, as shown in FIGS. 1 to 10: front plate 100 and rear plate 200 disposed on the rim of a space S to form the space S in the center when the table is unfolded; a left plate 300 and a right plate 400 which consist of a pair of plates coupled through a hinge H to enable folding and unfolding around the center in front and rear directions as a boundary; a corner plate 500 which is disposed at the edge of the table and is coupled to connect the front plate 100 with the left plate 300 and the right plate 400, and the rear plate 200 with the left plate 300 and the right plate 400, respectively, when unfolding the table, and consists of a pair of plates coupled through a hinge H in order to enable folding and unfolding around the center portion as a boundary; a pair of leg plates 600 which is coupled to a pair of plate bottom surfaces to form the corner plate 500, respectively, in a shape of wide-top and narrow-bottom to become narrower toward a lower side in order to support the corner plate 500, which in turn supports the front plate 100, the rear plate 200, the left plate 300 and the right plate 400, wherein the pair of leg plates 600 is interconnected through a hinge H to overlap while being in surface contact when the corner plate 500 is folded.

Herein, the front plate 100, the rear plate 200, the left plate 300, the right plate 400, the corner plate 500 and the leg plates 600 may be each made of metals such as stainless steel or aluminum, or synthetic resins.

For example, the front plate 100, the rear plate 200, the left plate 300 and the right plate 400 may be formed in a rectangular plate shape having a set length, while the corner plate 500 may have a sector shape formed by dividing a circle into ¼ to connect edge portions of the front plate 100, the rear plate 200, the left plate 300 and the right plate 400.

Further, the left plate 300 and the right plate 400 may further include a support block 700 which is coupled on the bottom surface of the center portion in the front and rear directions, as shown in FIGS. 2 and 6 to 8, to interlock with the hinges of the left plate 300 and the right plate 400, thereby supporting the left plate 300 and the right plate 400 in an unfolded state.

Figure 8:
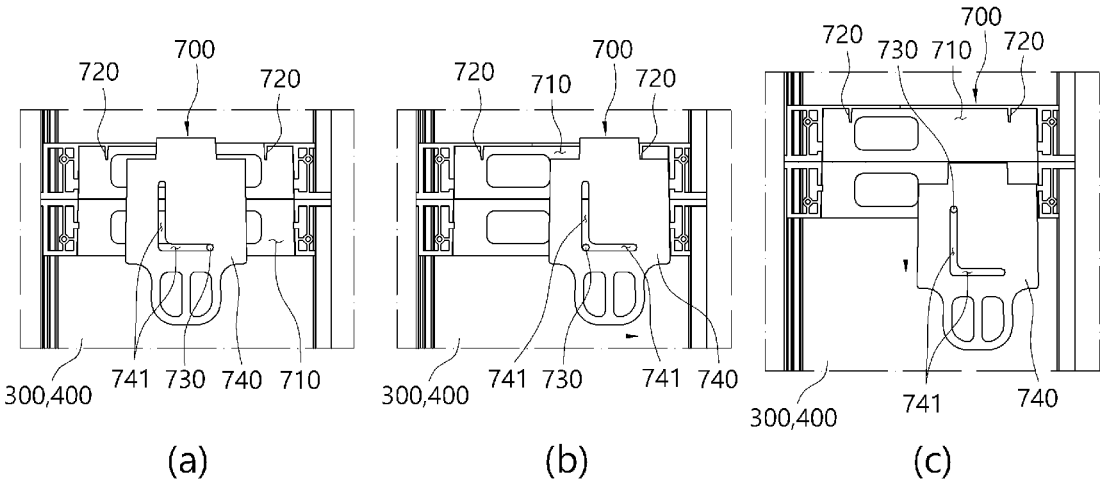
FIG. 8 is a cross-sectional view schematically illustrating the support block of the folding table according to the present invention.

At this time, the support block 700, as shown in FIG. 8, may comprise: a locking groove 710 formed on the inside to allow a support means 740 to be inserted and slide therein; a stopper projection 720 protruding from the locking groove 710 in order to restrict insertion and sliding of the support means 740; and a locking projection 730 fitted to a locking rail 741 formed in an "L" shape on the support means 740 when the support means 740 is inserted into the locking groove 710, so as to guide insertion of the support means 740 into the left or right side as well as sliding toward the center portion.

With regard to the support block 700, when the table is unfolded, as opposite to the order of the drawings shown in FIG. 8, the locking projection 730 is fitted to the locking rail 741 in a state in which the left plate 300 and the right plate 400 are unfolded, while the support means 740 is disposed on the left or right side (space side) and then inserted into the locking groove 710.

Further, when the user recognizes that the insertion is completed through the stopper projection 720 and the locking projection 730, the support means 740 is slidably moved within the locking groove 710 to the right or left side (outside of the space) to thus be positioned in the center of the support block 700 in a width direction, so that the unfolding of the table may be completed and excessive sliding movement of the support mans 740 may be blocked by the support projection 720 and the locking projection 730.

At this time, in a state in which the locking projection 730 is fitted to the locking rail 710 through the insertion and sliding movement of the support means 740, the locking projection 730 can be seen as moving in a pattern drawing an "L" shape while being fitted to the locking rail 741, this may be expected due to movement of the support means 740.

As such, when the table is unfolded, the support means 740 maintains a state in which the support means is slidably moved to the center portion in the width direction while being inserted into the left or right side of the support block 700 (space side), therefore, the left plate 300 and the right plate 400 may be firmly supported to thus prevent undesirable folding due to action of the external force, thereby ensuring stable use.

On the contrary, when the table is folded, as shown in FIG. 8, the support means 740 disposed in the center portion of the support block 700 slidably moves to the left or right side (space side), and then, is partially pulled out toward the front or rear direction, so that the left plate 300 and the right plate 400 may be foldable in a state in which complete insertion of the support means into the locking groove 710 is released.

In this case, since the support means 740 moves to the left or right side of the support block 700 (space side) in a state in which the locking projection 730 is fitted to the locking rail 741 of the support means 740, the table may be folded while the support means is not completely separated from the support block 700, so that it is possible to eliminate the fear of loss of the support means 740, in addition, not to interfere with the pair of leg plates 600 overlapping while being in surface contact with each other when the table is folded, thereby stably maintaining the folded state of the table.

Moreover, the left plate 300 and the right plate 400, as shown in FIGS. 1, 2, 5 and 6, may be each provided with a plurality of mounting blocks B interconnected and coupled to one another at an inner end facing a space S while protruding toward the space S, wherein the left and right ends of a plurality of seating plates 800 separably connected to one another are seated on the mounting blocks B to thus cover the space S.

In this regard, the plurality of seating plates 800 may be separably coupled to one another by forming coupling projections 810 or coupling grooves 820 corresponding to one another on front and rear ends thereof in the left and right directions (width direction), wherein the seating plates 800 may be separably connected and coupled to the front plate 100, the rear plate 200, the left plate 300 and the right plate 400 by forming extension projections or extension grooves E corresponding to the coupling projections 810 or coupling grooves 820 at opposite outer ends of the space S.

Accordingly, by means of the seating plates 800 to cover the space S, areas of the plates 100, 200, 300 and 400 constituting the table may be enlarged and secured. In addition, according to the configuration of the extension grooves or extension projections E possibly coupled to the coupling projections 810 and the coupling grooves 820, respectively, selective coupling of the seating plate 800 with any one of the front plate 100, the rear plate 200, the left plate 300 and the right plate 400 may be induced to thus easily extend or enlarge the area, thereby improving use efficiency of the table.

At this time, the coupling between the plurality of seating plates 800 or the selective coupling between the seating plate with any of the front plate 100, the rear plate 200, the left plate 300 and the right plate 400 may be implemented in a forced fitting manner or a sliding method between the coupling projections 810 and the coupling grooves 820, and between the extension projections or extension grooves E in response to the coupling projections 810 or coupling grooves 820.

On the other hand, the pair of leg plates 600, as shown in FIGS. 1 to 7 and 9, may be configured to include a pair of main leg parts 610 and a pair of auxiliary leg parts 620. In this regard, the pair of main leg parts 610 is coupled to the bottom surface of a pair of plate bottom surfaces constituting the corner plate 500, respectively, and may be configured to include sliding rails 611 formed on outer surfaces thereof in a longitudinal direction and a plurality of guide projections 612, which is formed on both sides in the longitudinal direction while protruding inwardly.

Further, the pair of auxiliary leg parts 620 is fitted to the sliding rails 611 in the longitudinal direction to ascend or descend while sliding, includes sliding grooves 621 and guide steps 622 formed on both sides thereof wherein the guide projections 612 are fitted to the sliding grooves 621 to thus guide the sliding, and may be configured to be interconnected at a lower end through a soft hinge 623, while being coupled to the pair of main leg parts 610, respectively, to thus extend a length of the pair of leg plates 600.

For example, the sliding groove 621 may be formed in a "L" shape along the longitudinal direction, and the guide step 622 may extend inwardly from its side end thereof to guide the auxiliary leg part 620 to stably slide on the sliding rail 611 in the longitudinal direction in a state in which the guide projections 612 are fitted to the sliding grooves 621 and hung on the guide steps 622.

Specifically, since the pair of auxiliary leg parts 620 constituting the pair of leg plates 600 are integrally connected through the soft hinge 623, it is possible to easily respond the leg plates 600 in a triangle or a triangular pyramid-like shape with wide top and narrow bottom to become narrower toward the lower side so that the auxiliary leg parts slide downward from the main leg parts 610 and can extend a length of the leg plates 600 while firmly supporting the corner plate 500, thereby stably supporting the front plate 100, the rear plate 200, the left plate 300 and the right plate 400.

Further, the pair of auxiliary leg parts 620 may be provided with a plurality of fitting holes 624 formed in the longitudinal direction, while the pair of main leg parts 610 may have leaf springs 613 at the lower end of the sliding rail 611 and fitting projections 614 protruding outward from the leaf springs 613, so that the fitting projections 614 may be selectively fitted to the plurality of fitting holes 624 by the auxiliary leg parts 620 ascending and descending through sliding.

Through this, according to the installation environment of the table or a height or leg length of the user, it is possible to extend the length of the leg plate 600 while differently adjusting the length, in addition, it is also possible to secure the stability of installation and maintenance according to the coupling of the fitting projections 614 and the fitting holes 624, thereby improving use efficiency of the table.

Figure 7:
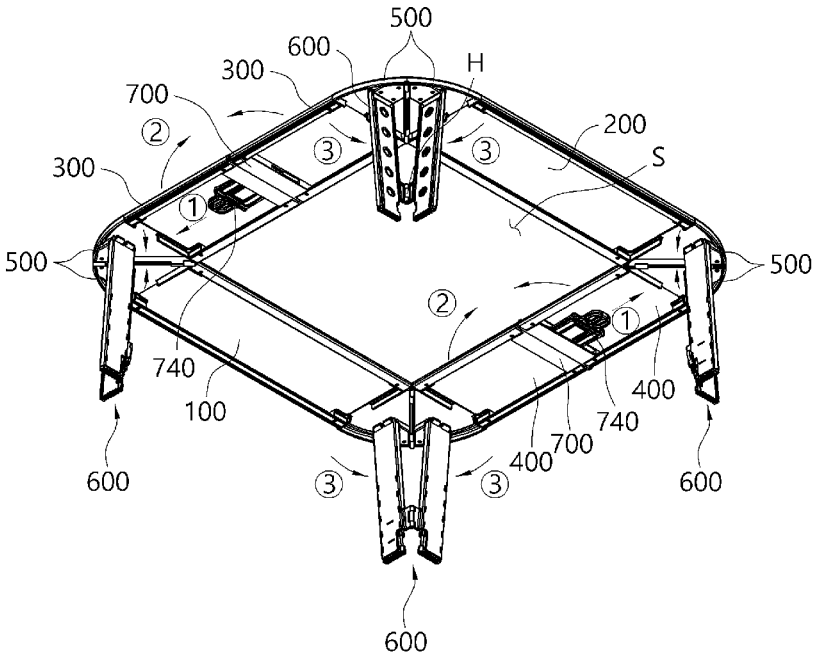

In addition, after unfolding and using the FOLDING TABLE according to the present invention, if intended to selectively fold the plates constituting the table and to store and transport the table, as shown in FIGS. 1 and 7, the plurality of seating plates 800 are firstly separated, followed by sliding the auxiliary leg parts 620 upward through the sliding rails 611 not to expose the same below the main leg parts 610.

Figure 9:
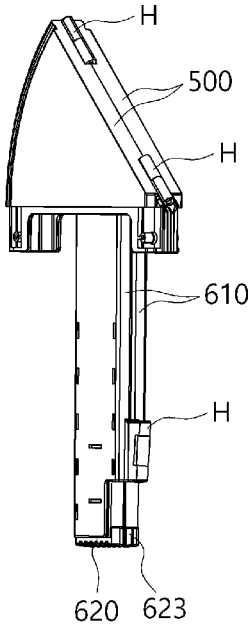
FIG. 9 is a perspective view schematically illustrating a folded state of the corner plate and the leg plate of the FOLDING TABLE according to the present invention.

Next, as described above with reference to FIGS. 7 and 8, after partially pulling out the support means 740 from the locking groove 710, the left plate 300 and the right plate 400 are respectively folded about the hinge H as a boundary. At the same time, as shown in FIG. 9, the corner plate 500 integrally coupled with the left plate 300 and the right plate 400 is also folded about the hinge H as a boundary such that a pair of plates is folded, whereby the pair of leg plates 600 may also be placed in a state of overlapping while being into surface contact with each other.

Figure 10:
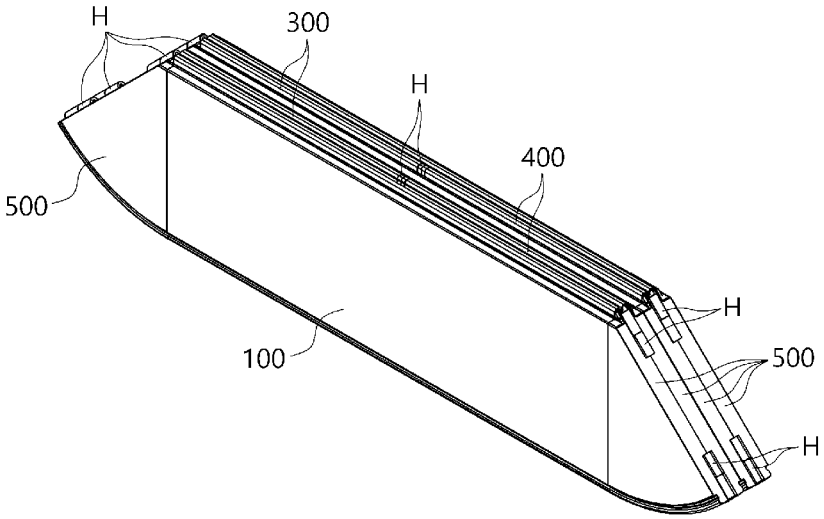
FIG. 10 is a perspective view schematically illustrating a folded state of the FOLDING TABLE according to the present invention.

At the end, as shown in FIG. 10, the left plate 300 and the right plate 400 folded along the hinge H may be interposed between the bottom surfaces of the front plate 100 and the rear plate 200, in a state in which the corner plates 500 are folded to overlap.

Further, the pair of leg plates 600 at each of the corner plates 500, which connect the front plate 100 with the left plate 300 and the right plate 400, may be in surface contact with each other to overlap, and then may be interposed between the bottom surfaces of the left plate 300 and right plate 400 and the bottom surface of the front plate 100 in front of a site where the left plate 300 and the right plate 400 are folded and top surfaces thereof are in surface contact with each other.

Similarly, the pair of leg plates 600 at each of the corner plates 500, which connect the rear plate 200 with the left plate 300 and the right plate 400, may be in surface contact with each other to overlap, and then may be interposed between the bottom surfaces of the left plate 300 and right plate 400 and the bottom surface of the rear plate 200 at the rear of the site where the left plate 300 and the right plate 400 are folded and top surfaces thereof are in surface contact with each other, thereby enabling storage or transport of the table with minimized volume.

As described above, the present invention has been illustrated and described with reference to specific embodiments, however, the present invention is not limited to the above-described embodiments, and various changes and modifications are possible without departing from the technical spirit of the present invention.

(Description of Reference Numerals)

100: Front plate
200: Rear plate
300: Left plate
400: Right plate
500: Corner plate
600: Leg plate
610: Main leg
611: Sliding rail
612: Guide projection
613: Leaf spring
614: Fitting projection
620: Auxiliary leg part
621: Sliding groove
622: Guide step
623: Soft hinge
624: Fitting hole
700: Support block
710: Locking hole
720: Stopper projection
730: Locking projection
740: Support means
741: Locking rail
800: Seating plate
810: Coupling projection
820: Coupling groove
B: Mounting block
E: Extension projection or extension groove
H: Hinge
S: Space

What is claimed is:

1. A FOLDING TABLE, comprising:

a front plate and a rear plate disposed on a rim of a space to form the space in the center when the table is unfolded, as well as a left plate and a right plate which are composed as a pair of plates to be coupled through a hinge such that these plates can be folded and unfolded about a center portion in front and rear directions as a boundary;

a corner plate which is disposed at each edge of the table in order to connect the front plate with the left and right plates, and the rear plate with the left and right plates, respectively, when unfolding the table, and consists of a pair of plates coupled through a hinge to enable folding and unfolding about the center portion as a boundary; and a pair of leg plates which is coupled to a pair of plate bottom surfaces to form the corner plate, respectively, in a shape of wide-top and narrow-bottom to become narrower toward a lower side in order to support the corner plate, which in turn supports the front, rear, left and right plates, wherein the pair of leg plates is interconnected through a hinge to overlap while being in surface contact when the corner plate is folded, and wherein the pair of leg plates includes:

a pair of main leg parts that is coupled to the pair of plate bottom surfaces constituting the corner plate, respectively, includes sliding rails formed on an outer surface in a longitudinal direction and a plurality of guide projections protruding inwardly, which is formed on both sides in the longitudinal direction; and a pair of auxiliary leg parts that is fitted and coupled to the sliding rails in the longitudinal direction to thus ascend and descend while sliding, includes sliding grooves and guide steps formed on both sides so that the guide projections are fitted to the sliding grooves to thus guide the sliding, wherein the auxiliary leg parts are interconnected through a soft hinge at a lower end thereof to be coupled to the main leg parts, respectively, to thus extend a length of the pair of leg plates.

2. The FOLDING TABLE according to claim 1, wherein the left plate and the right plate each further include a support block coupled to the bottom surface of the center portion in front and rear directions to interlock with the hinges of the left plate and right plate to thus support the left plate and right plate in an unfolded state, wherein the support block includes:

a locking groove formed on the inside to allow a support means to be inserted and slide therein;

a stopper projection protruding from the locking groove in order to restrict insertion and sliding of the support means; and a locking projection fitted to a locking rail formed in an "L" shape on the support means when the support means is inserted into the locking groove, so as to guide insertion of the support means into the left or right side as well as sliding toward the center portion.

3. The FOLDING TABLE according to claim 1, wherein the pair of auxiliary leg parts includes a plurality of fitting holes formed along the longitudinal direction, while the pair of main leg parts is provided with leaf springs at the lower end of the sliding rails and fitting projections protruding outward from the leaf springs, so that the fitting projections are selectively fitted to the fitting holes by the auxiliary parts ascending and descending through sliding.

4. The FOLDING TABLE according to claim 1, wherein the left plate and the right plate are provided with a plurality of mounting blocks coupled to one another at an inner end facing the space while protruding toward the space, wherein the left and right ends of a plurality of seating plates separably connected to one another are seated on the mounting blocks to thus cover the space.

5. The FOLDING TABLE according to claim 4, wherein the plurality of seating plates is separably coupled to one another by forming coupling projections or coupling grooves corresponding to one another on front and rear ends thereof in the left and right directions, wherein the seating plates are separably connected and coupled to the front, rear, left and right plates by forming extension projections or extension grooves corresponding to the coupling projections or coupling grooves at opposite outer ends of the space.

6. The FOLDING TABLE according to claim 1, wherein, when the table is folded, the left and right plates folded at the hinge as a boundary while the corner plates are folded to overlap are interposed between the bottom surfaces of the front and rear plates, wherein the pair of leg plates at each of the corner plates, which connect the front plate with the left and right plates, is in surface contact with each other to overlap and then is interposed between the bottom surfaces of the left and right plates and the bottom surface of the front plate in front of a site where the left plate and the right plate are folded and top surfaces thereof are in surface contact with each other, and wherein the pair of leg plates at each of the corner plates, which connect the rear plate with the left and right plates, is in surface contact with each other to overlap and then is interposed between the bottom surfaces of the left and right plates and the bottom surface of the rear plate at the rear of the site where the left plate and the right plate are folded and top surfaces thereof are in surface contact with each other.

* * * * *